US008528771B2

(12) United States Patent
Voss et al.

(10) Patent No.: US 8,528,771 B2
(45) **Date of Patent: *Sep. 10, 2013**

(54) ANGLED PIERCING FLIPTOP CLOSURE

(75) Inventors: Leslie A. Voss, Jacksonville, FL (US); Catie A. Morley, Jacksonville, FL (US); James Timothy Davis, Jacksonville, FL (US); Gary S. Hall, St. Johns, FL (US)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 212 days.

This patent is subject to a terminal disclaimer.

(21) Appl. No.: 13/094,746

(22) Filed: Apr. 26, 2011

(65) Prior Publication Data

US 2012/0273451 A1 Nov. 1, 2012

(51) Int. Cl.
*B65D 17/42* (2006.01)

(52) U.S. Cl.
USPC ..... 220/277; 220/258.4; 220/278; 206/222

(58) Field of Classification Search
USPC ..... 215/257, 301; 220/278, 258.1, 258.2, 220/258.3, 258.4, 258.5, 277; 222/83; 206/222
See application file for complete search history.

(56) References Cited

U.S. PATENT DOCUMENTS

| | | | | |
|---|---|---|---|---|
| 2,893,611 | A * | 7/1959 | Akers | 222/536 |
| 4,216,880 | A * | 8/1980 | Drelichowski | 222/83 |
| 4,860,934 | A * | 8/1989 | Komischke | 222/534 |
| 5,392,968 | A * | 2/1995 | Dark | 222/529 |
| 5,884,793 | A * | 3/1999 | Wang | 215/389 |
| 5,908,126 | A * | 6/1999 | Wang | 215/229 |
| 6,161,728 | A * | 12/2000 | Dark | 222/83 |
| 6,257,449 | B1 * | 7/2001 | Baerenwald | 222/83 |
| 6,390,341 | B1 * | 5/2002 | Ohmi et al. | 222/536 |
| 6,471,101 | B1 * | 10/2002 | Vardanyan | 222/541.2 |
| 6,685,055 | B2 * | 2/2004 | Taylor | 222/83 |
| 6,976,611 | B2 * | 12/2005 | Lee | 222/536 |
| 6,983,861 | B2 * | 1/2006 | Lin et al. | 222/83 |
| 7,059,490 | B2 * | 6/2006 | Son | 220/254.3 |
| 7,152,767 | B2 * | 12/2006 | Seelhofer | 222/536 |
| 7,828,140 | B2 * | 11/2010 | Lee et al. | 206/222 |
| 2003/0071057 | A1 * | 4/2003 | Suffa | 222/83.5 |
| 2004/0089165 | A1 * | 5/2004 | Seelhofer | 99/516 |
| 2007/0181522 | A1 * | 8/2007 | Davidson | 215/228 |
| 2009/0084814 | A1 * | 4/2009 | Wisniewski et al. | 222/83 |
| 2011/0100991 | A1 * | 5/2011 | Voss et al. | 220/315 |

FOREIGN PATENT DOCUMENTS

| | | | |
|---|---|---|---|
| WO | WO 02/053469 | A1 | 7/2002 |
| WO | WO 2006/057536 | A1 | 6/2006 |
| WO | WO 2011/053579 | A1 | 5/2011 |

OTHER PUBLICATIONS

International Search Report mailed Nov. 30, 2011 for corresponding Application No. PCT/US2011/034027.

* cited by examiner

*Primary Examiner* — Anthony Stashick
*Assistant Examiner* — Christopher McKinley

(57) ABSTRACT

The invention closures that opens sealed containers and close such containers thereafter and method of using the same.

18 Claims, 5 Drawing Sheets

ANGLED PIERCING FLIPTOP CLOSURE

FIELD OF THE INVENTION

This invention relates to closures that opens sealed containers and close such containers thereafter.

BACKGROUND

Liquid products such as foods, cosmetic products, pharmaceutical products and the like are packaged in containers that are sealed to prevent contamination from tampering or environmental factors. Some of these liquids are sterilized prior to their encapsulation in a container and some liquids are sterilized along with their containers after encapsulation of the liquid. In either case, a sealed container is presented to the consumer and the consumer often has difficulty in opening the container. One particular method of encapsulating sterilized liquids in their container is commonly known as Blow-Fill-Seal ("BFS"). In this method liquid products are sterilized and immediately loaded to molded plastic bottles shortly after such containers are molded while the molded plastic is at an elevated temperature. This procedure reduces the cost of producing a sterilized product because the encapsulated liquid product and its packaging do not need to be sterilized after loading. This is particularly beneficial for products that cannot be sterilized after there are loaded to the bottle due to stability concerns. However, BFS produces container that must be opened by cutting through the container material and often consumers have trouble opening such containers. Further in the case of multiple use liquid products, such a pharmaceutical products, the consumer must also have a method of resealing the container from environmental factors and accessing its contents at another time. It would be useful if there were closure that opened sealed containers and thereafter permitted the user to close such containers to protect the contents from environmental factors. This need is met by the following invention.

DETAILED DESCRIPTION OF THE INVENTION

Figure 1:
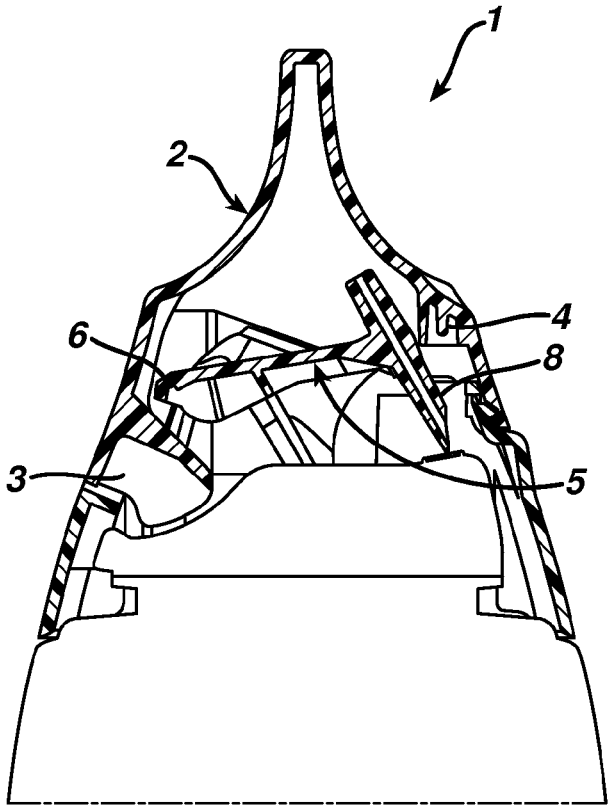
FIG. 1 illustrates a cross sectional of a closure of the invention
Figure 2:
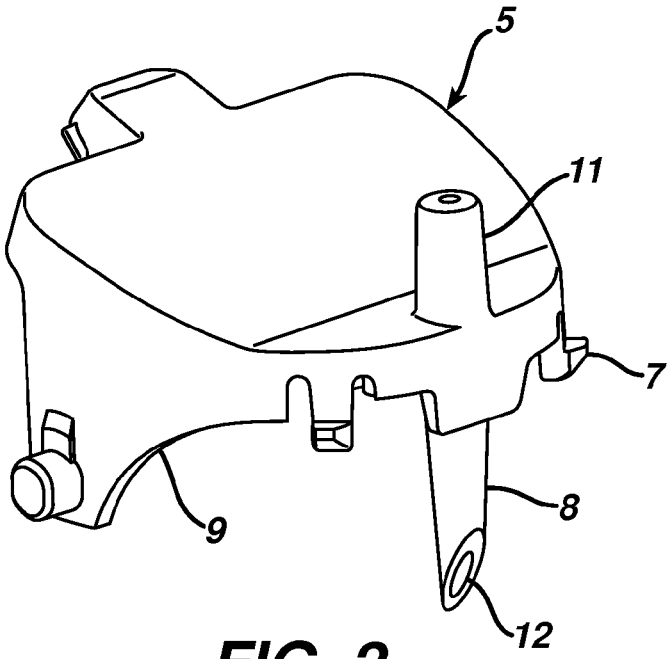
FIG. 2 illustrates a perspective view of a pierce plate cross sectional view of a closure of the invention and an attached container.
Figure 3:
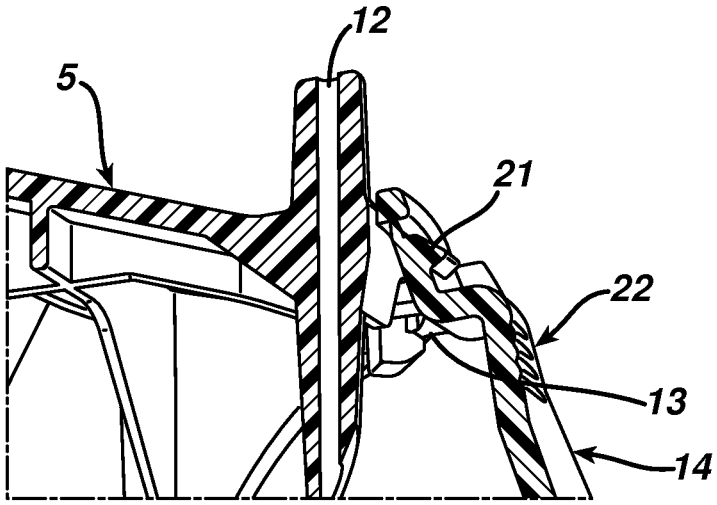
FIG. 3 illustrates a cross sectional view of a pierce plate engaged with a container skirt

This invention includes a closure for opening and covering a sealed container comprising a pierce plate, a cap, a container skirt, and a truss wherein said closure moves between a first closed position, an open position and a second closed position.

wherein said pierce plate comprises an upper surface, an aperture, a rim lock portion, and a lower surface, wherein said lower surface comprises a loading portion, and a piercing portion wherein said piercing portion comprises a channel which is juxtaposed to the lower surface and aligned with said aperture to permit fluid to flow between the channel and the aperture wherein when the closure is in the first closed position, the upper surface of said piercing plate sits on an inclined plane at an angle from the portion of the upper surface proximal to the loading portion to the portion of the upper surface proximal to the rim lock portion wherein said portion of the upper surface proximal to the loading portion is below the horizontal plane and the portion of the upper surface proximal to the rim lock portion is above the horizontal plane wherein said loading portion moves in response to the movement of the cap from the first closed position to open position.

wherein said truss comprises a pierce plate end and a pivot end, wherein said pierce plate end is juxtaposed to the lower surface of said pierce plate wherein said truss moves pivotally about the pivot end in response to the movement of the pierce plate wherein said cap comprises an aperture cover, an inner surface, an outer surface, and said inner surface further comprises a foot that moves in response to the movement of the cap wherein said foot is proximal to the loading portion of the pierce plate and contacts said loading portion of the pierce plate to move said loading portion when the cap moves from the first closed position to the open position wherein when said cap moves from the open position to the second closed position said foot moves substantially tangential to said loading portion of the pierce plate but does not substantially move said pierce plate when said cap moves between the open position to the second closed position wherein said container skirt comprises a rim stop, wherein said container skirt is pivotally attached to said cap and adapted to mate with a container wherein when pierce plate moves in response to the movement of said foot portion said rim lock portion engages said rim stop to substantially hold said pierce plate FIG. 1 illustrates a cross sectional view of a closure 1 of the invention. Foot 3 and aperture cover 4 sit on the inner surface of cap 2. Pierce plate 5 is inclined at an angle from the loading portion 6 to the rim lock portion 7, shown in FIG. 2. Loading portion 6 and piercing portion 8 are on the lower surface of pierce plate 5. FIG. 2 illustrated a perspective view of pierce plate 5 with spout 11 and truss 9 attached to the lower surface of pierce plate 5. Spout 11 attaches to the aperture (not shown) and piercing portion 8 of pierce plate 5 to form channel 12. FIG. 3 illustrates a cross sectional portion of pierce plate 5 and channel 12 when the closure is in the open and the second closed positions. The rim lock portion 7 is engaged to the rim stop 13 of container skirt 14.

Figure 4:
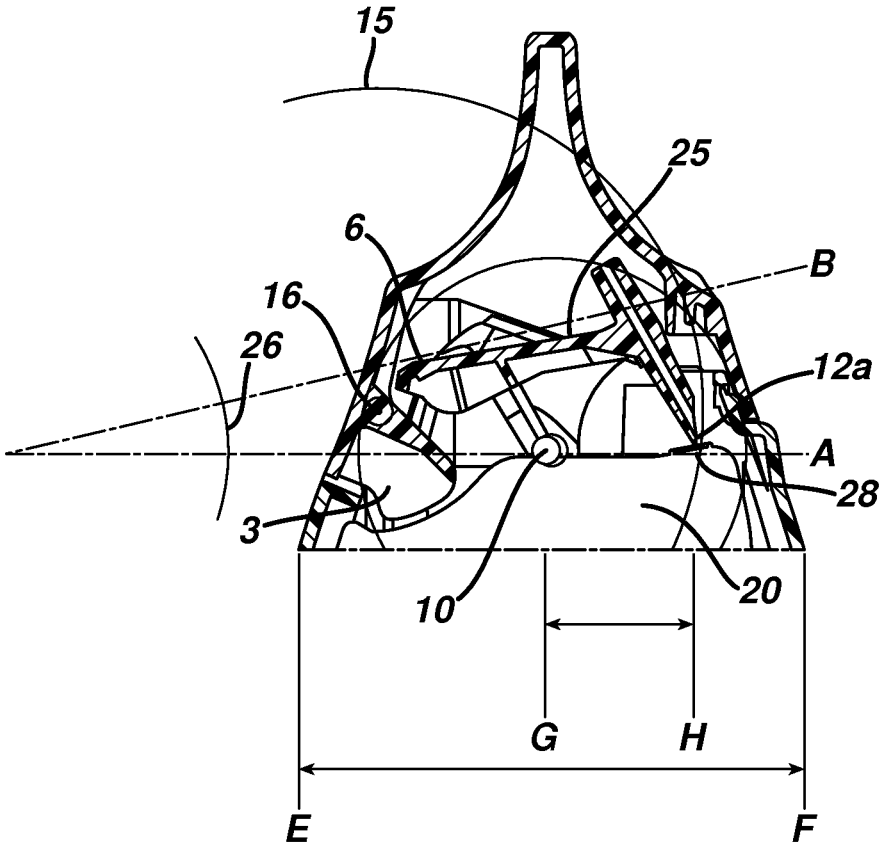
FIG. 4 illustrates a cross sectional view of a closure in the first closed position attached to a container.
Figure 5:
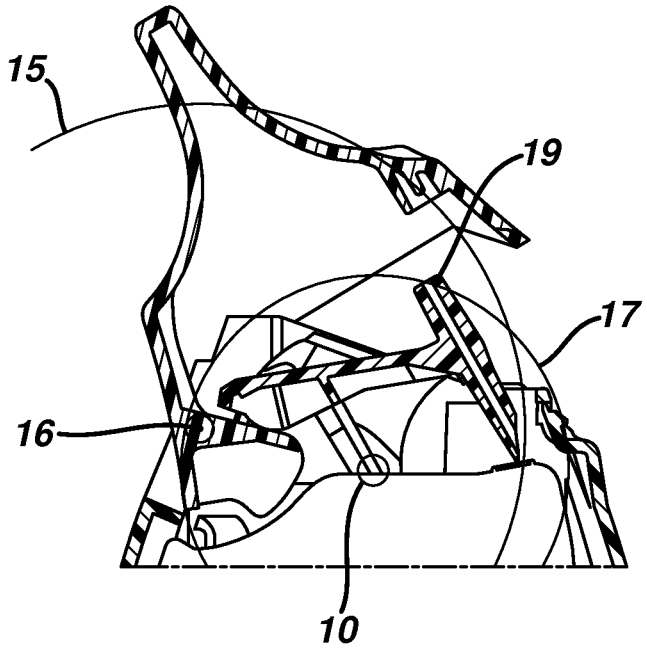
FIG. 5 illustrates a cross sectional view of a closure moving between a first closed position and an open position.
Figure 6:
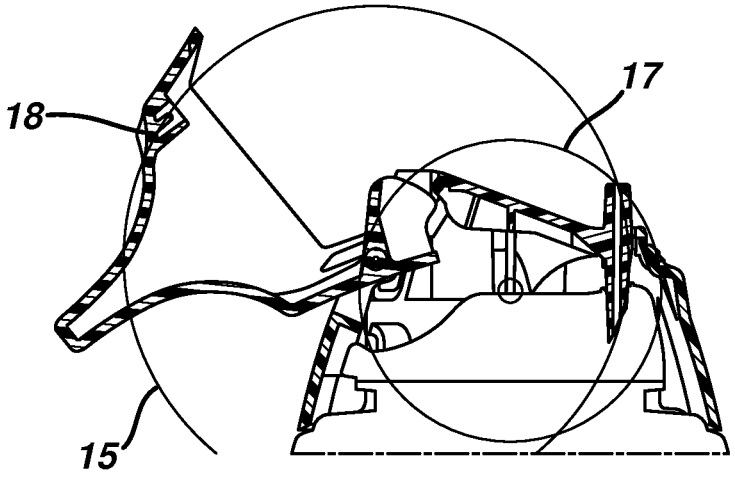
FIG. 6 illustrates a cross sectional view of a closure in the open position
Figure 7:
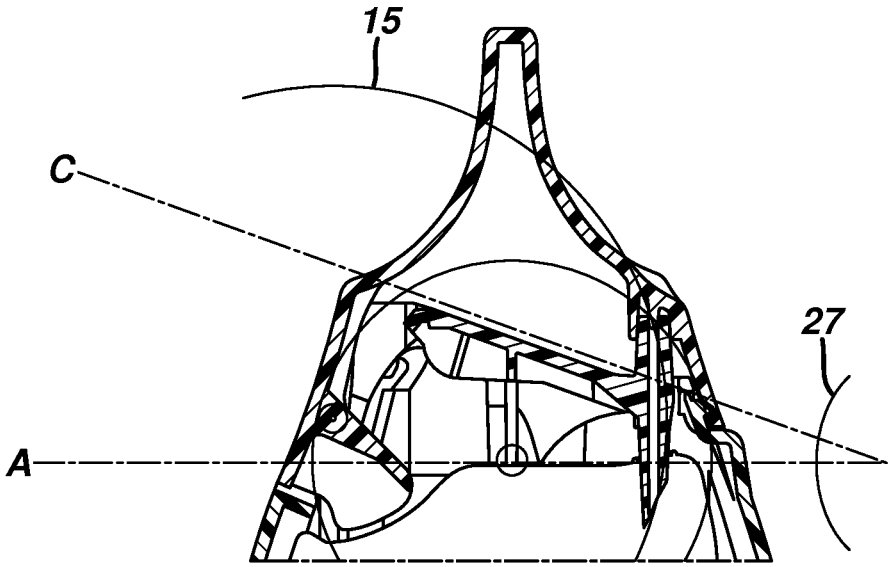
FIG. 7 illustrates a cross sectional view of a closure in the second closed position.

When a user received a sealed BFS bottle which is fastened to the closure of the invention, the closure is in the first closed position and FIG. 4 illustrates closure 1 in a first closed position. When the user opens the bottle, the closure moves to an open position and pierces the sealed BFS bottle as illustrated by FIG. 6. When the user closes the unsealed BFS bottle, the closure moves to a second position, which is illustrated by FIG. 7. FIG. 5 illustrates cap 2 moving between the first closed position to the open position. Container skirt 14 is attached to bottle 20 and pierce point 12*a* sits juxtaposed to bottle 20. Foot 3 moves closer to loading portion 6 as cap 2 moves to the open position FIG. 6 illustrates the open position and pierce point 12 has pierced bottle 20 to allow the liquid contents of bottle 20 access to channel 12.

In the first closed position, pierce plate 5 is inclined at an angle 26 which is measured from drawing a line on the upper surface 25 of pierce plate 5 and measuring the angle that this line makes with the horizontal plane. The horizontal plane is marked by line A and the incline of upper surface 25 is marked by line B in FIG. 4 In the second closed position and the open position pierce plate 5 is located at inclined at an angle which is measured from drawing a line on the upper surface 25 of pierce plate 5 and measuring the angle that this line makes with the horizontal plane. In these position, the portion of the upper surface which is located proximal to the rim lock 7 is below the horizontal plane The horizontal plane is marked by line A and the incline of upper surface 25 is marked by line C in FIG. 7 to demark second angle 27 The required measurement of angle 26 and second angle 27 is determined by the geometry of the bottle to be pierced. In the embodiment of FIGS. 4 and 7, embodiment the upper shoulder of the bottle, measured on the horizontal has a diameter of 50 mm measured from lines E to F and the distance from pivot point 10 to strike point 28 is 14 mm, measured from lines G to H. In this embodiment angle 26 is between about 8 degree and about 12 degrees, preferably about 9 degrees to about 10 degrees, most preferably about 10 degrees from the horizontal line. In the same embodiment second angle 27 is between about 15 degree and about 24 degrees, preferably about 18 degrees to about 22 degrees, most preferably about 20 degrees from the horizontal line. In the preferred embodiment angle 26 and second angle 27 are substantially similar, and are between about 15 degrees and about 24 degrees.

In the preferred embodiments substantially no liquid flows from the spout 11 in the second closed position. To accomplish this, the geometry of aperture cover 4 must accommodate the first closed position and the second closed position and the spout 11 must mate with aperture cover 4 in the second closed position. The center 16 of circle 15 is the pivot point for movement of cap 2 between the first closed, open, and second closed positions. The radius of circle 15 is found by drawing a line from center 16 through the aperture cover 4 at point 18, proximal to the inner surface of cap 2 and shown in FIG. 6.

FIG. 4, illustrates pivot end 10 as the center for the circle 17. The radius of circle 17 is found by drawing a line from pivot 10 to a second point 19, located at the top of spout 11 in the middle of channel 12. This second point 19 is illustrated in FIG. 5. The pivot end 10 of truss 9 pivots in response to the movement of pierce plate 5.

FIG. 7 illustrates the second closed position. In this embodiment the aperture cover 4 fits over spout 11, to form a substantially liquid tight seal at the intersection of circle 17 and circle 15. However aperture cover 4 could fit into channel 12 of spout 11. To accomplish this, also at the intersection of circle 17 and circle 15.

In the preferred embodiments, piercing portion 8 is conical in shape where it is wider in the portion proximal to the lower surface of the pierce plate and narrower in the portion distal to the lower surface of the pierce plate (adjacent to bottle 20 in the first closed position). In the most preferred option the distal portion of piercing portion 8 is cut on a diagonal as shown in FIG. 5, With respect to rim lock 7, it is preferred that the pierce place has at least two rim locks on either side of pierce portion 8, and said rim locks may be any of a number of either forced fit or interlocking structures. In the first closed and the second closed position, the cap by be held in place by skirt lock 21, located on the exterior surface of skirt 14. In the illustrated embodiment, skirt lock 21 may be released by exerting pressure on area 22 of container skirt 14. With respect to truss 9, it is preferred that there are two or more trusses juxtaposed to the lower surface of the pierce plate.

Additional features may be added to improve the design. One such improvement is a feature to keep cap from closing when fluid is dispensed.

Figure 8:
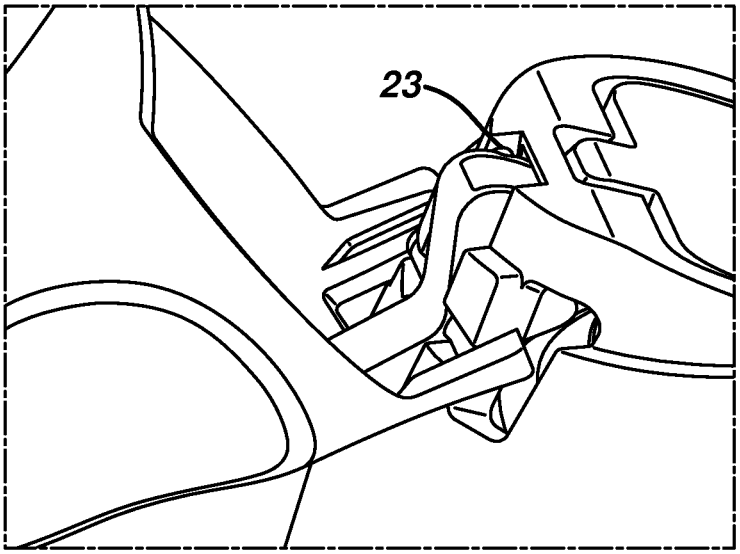
FIG. 8 illustrated a perspective view of a closure in the open position.
Figure 9:
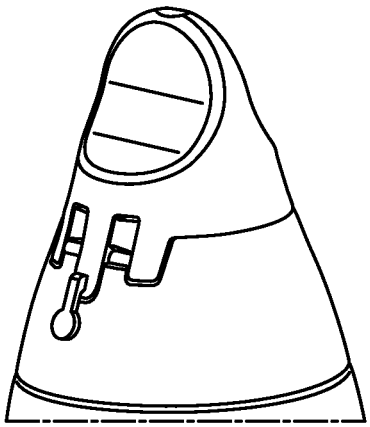
FIG. 9 illustrates perspective view of a closure in the first closed position with a tamper seal.

FIG. 8 illustrates an opening 23 in container skirt 14 and its corresponding detent which engages portion of cap 2 when the cap is in the open position and may be released by exerting light pressure on cap 2. Another feature is adding a tamper evident seal to the cap as shown in FIG. 9.

The foregoing closures may be made by a variety of plastic materials. It is preferred that the piercing portion is made of any material that is harder than the container, such as polycarbonate. The remainder of the pierce plate and truss may be made of the same material as well. of these pieces may be made of unitary construction The container skirt and the cap are preferably made of polypropylene. The container may be made of polypropylene as well. However the container is most preferably made of high density polyethylene or preferably low or medium density polyethylene. The cap may be connected to the container skirt by a number of hinging methods including interlocking hinges and living hinges. The pierce plate can be a separate piece as described herein or combined with the container skirt, the cap, or both using living hinges or flexible material methods to achieve the necessary movement. The cap, and the container skirt may be made separately of different materials. Any of these pieces may be made of unitary construction with or without the container. In the preferred embodiment the foot and the cap are made of unitary construction. Containers which are used with the closures of this invention may be of unitary construction with one or more parts of the closure. For example, the container skirt may be made of unitary construction with the container. Any or all of the components of the closure may be made by injection molding (two material injection molding, over-molding, sandwich molding or insert molding). The container is preferably made by BFS, but may be made of other processes that seal the bottle prior to shipment to the consumer. Machines to perform these task including but not limited to those manufactured by Arburg Gmbh, Ferromatik, Elektra, Engel, Rommelag, and others. Other combinations of materials and construction methods are known to those of skill in the art of molding plastic materials and although such materials and methods are not specifically mentioned herein they are considered to be included in this invention, The foregoing embodiments are only meant to illustrate the invention and not limit it. Those knowledgeable in closures as well as other specialties may find other methods of practicing the invention. However, those methods are deemed to be within the scope of this invention.

What is claimed is:

1. A closure for opening and covering a sealed container comprising a pierce plate, a cap, a container skirt, and a truss wherein said closure moves between a first closed position, an open position and a second closed position wherein said pierce plate comprises an upper surface, an aperture, a rim lock portion, and a lower surface, wherein said lower surface comprises a loading portion, and a piercing portion wherein said piercing portion comprises a channel which is juxtaposed to the lower surface and aligned with said aperture to permit fluid to flow between the channel and the aperture wherein when the closure is in the first closed position, the upper surface of said piercing plate sits on an inclined plane at an angle from the portion of the upper surface proximal to the loading portion to the portion of the upper surface proximal to the rim lock portion wherein said portion of the upper surface proximal to the loading portion is below a horizontal plane and the portion of the upper surface proximal to the rim lock portion is above the horizontal plane wherein said loading portion moves in response to the movement of the cap from the first closed position to open position wherein said truss comprises a pierce plate end and a pivot end, wherein said pierce plate end is juxtaposed to the lower surface of said pierce plate wherein said truss moves pivotally about the pivot end in response to the movement of the pierce plate wherein said cap comprises an aperture cover, an inner surface, an outer surface, and said inner surface further comprises a foot that moves in response to the movement of the cap wherein said foot is proximal to the loading portion of the pierce plate and contacts said loading portion of the pierce plate to move said loading portion when the cap moves from the first closed position to the open position wherein when said cap moves from the open position to the second closed position said foot moves substantially tangential to said loading portion of the pierce plate but does not substantially move said pierce plate when said cap moves between the open position to the second closed position wherein said container skirt comprises a rim stop, wherein said container skirt is pivotally attached to said cap and adapted to mate with a container wherein when pierce plate moves in response to the movement of said foot portion said rim lock portion engages said rim stop to substantially hold said pierce plate.

2. The closure of claim 1 wherein said pierce plate further comprises a rear latch, wherein said rear latch is proximal to the loading portion and moves with said pierce plate between the first closed position and the open position.

3. The closure of claim 2 said container skirt comprises a rear catch wherein said rear latch engages said rear latch when the pierce plate moves from the first closed position to the open position.

4. The closure of claim 1 comprising at least two trusses.

5. The closure of claim 1 wherein said truss is pivotally attached to said container skirt.

6. The closure of claim 1 wherein said container skirt is mated to a bottle comprising an upper bottle surface and said truss is pivotally juxtaposed to said upper bottle surface.

7. The closure of claim 1 wherein said pierce plate comprises two or more rim locks.

8. The closure of claim 1 wherein said piercing portion is tapered from a wider portion proximal to said aperture to a narrow portion.

9. The closure of claim 8 wherein said container skirt is mated to a bottle comprising an upper bottle surface, wherein when said cap moves from the first closed position to the open position, said piercing portion bores through a portion of the upper bottle surface to form a substantially liquid tight seal between the upper bottle surface and the pierce portion.

10. The closure of claim 1 wherein the rim lock portion is located on the lower surface of the pierce plate.

11. The closure of claim 1 comprising two or more rim lock portions.

12. The closure of claim 1 wherein the cap further comprises an open latch and the container skirt further comprises an open catch, wherein said open latch and said open catch engage when the closure is in the open position and release when the closure in the first closed or the second closed position.

13. The closure of claim 1 wherein the container skirt further comprises a release lever wherein said release lever is releasably attached to the cap to attach the cap to the container skirt in the first closed or the second closed position and releases the cap from the container skirt due to the application of an external force.

14. The closure of claim 1 further comprising a tamper seal, wherein the container skirt is releasably attached to the cap in the first closed position, by said tamper seal.

15. The closure of claim 1 wherein when said closure is in the open position and the second closed position, said pierce plate is oriented at a second angle wherein the upper surface of said piercing plate sits on an inclined plane at an angle from the portion of the upper surface proximal to the rim lock portion to the upper surface proximal to the loading portion to the portion wherein said angle is measured by orienting the upper surface along a substantially horizontal plane and angling the portion of the upper surface proximal to the loading portion above the substantially horizontal plane and the upper surface proximal to the rim lock below the substantially horizontal plane.

16. The closure of claim 1 further comprising a blow fill seal bottle attached to said closure by the container skirt.

17. The closure of claim 16 wherein the blow fill seal bottle is attached to said container skirt by a snap fit.

18. The closure of claim 16 wherein the blow fill seal bottle is attached to the container skirt by a threaded connection.

* * * * *